United States Patent [19]

Hollander, Jr.

[11] 4,093,067

[45] June 6, 1978

[54] MIXING PACKAGE

[75] Inventor: Edward F. Hollander, Jr., Broomall, Pa.

[73] Assignee: John P. Glass, Essington, Pa.

[21] Appl. No.: 739,476

[22] Filed: Nov. 8, 1976

[51] Int. Cl.[2] ..... B65D 25/08

[52] U.S. Cl. ..... 206/219; 62/4; 215/DIG. 8; 222/94; 222/183

[58] Field of Search ..... 206/219, 222; 222/94, 222/183; 62/4; 215/DIG. 8

[56] References Cited

U.S. PATENT DOCUMENTS

| | | | |
|---|---|---|---|
| 2,834,345 | 5/1958 | Tabbert | 222/94 |
| 2,895,475 | 7/1959 | Cole | 206/219 |
| 2,900,100 | 8/1959 | Debat et al. | 206/222 |
| 2,907,173 | 10/1959 | Robbins | 206/219 |
| 3,175,558 | 3/1965 | Caillouette et al. | 206/219 |
| 3,204,825 | 9/1965 | Underwood | 222/183 |
| 3,638,786 | 2/1972 | Borecki et al. | 206/219 |
| 3,736,933 | 6/1973 | Szabo | 222/94 |
| 3,813,534 | 5/1974 | Gilliam | 206/219 |
| 3,950,158 | 4/1976 | Gossett | 206/219 |
| 3,964,643 | 6/1976 | Morane et al. | 206/219 |
| 3,986,834 | 10/1976 | Steinbrink, Jr. | 206/219 |

FOREIGN PATENT DOCUMENTS

| | | | |
|---|---|---|---|
| 606,387 | 10/1960 | Canada | 62/4 |
| 560,029 | 6/1923 | France | 222/94 |
| 1,248,882 | 11/1960 | France | 206/219 |

*Primary Examiner*—William Price
*Assistant Examiner*—Joseph M. Moy
*Attorney, Agent, or Firm*—Smith, Harding, Earley & Follmer

[57] ABSTRACT

A package comprising a tube of flexible material having a first and second end, a first ultrasonic seal extending transversely across the tube and closing said first end, a second ultrasonic seal extending transversely across the tube and closing said second end, a chamber formed by said tube and end seals for containing contents, a hollow stem extending through and supported by the second seal with an inner end inside the chamber and an outer end outside the chamber, and a removable seal closing the outer end of the stem, said stem seal being removable when it is desired to dispense the contents from the package.

6 Claims, 7 Drawing Figures

MIXING PACKAGE

CROSS REFERENCE TO RELATED APPLICATIONS

This application is related to my following patent applications, all incorporated herein by reference: Ser. No. 720,084, filed Sept. 2, 1976, for PACKAGES, and Ser. No. 739,475 filed Nov. 8, 1976 for PACKAGING METHOD and Ser. No. 739,477 filed Nov. 8, 1976 now U.S. Pat. No. 4,048,396 for BATTERY PACKAGE, both of which are being executed concurrently herewith.

BACKGROUND OF THE INVENTION

It has been a problem to provide a package having dispensing means that is capable of reaching into rather inaccessible places. It has also been a problem to provide such a package as a one-shot dispensing package for liquids that is opened by squeezing with only one hand, that is inexpensive, that permits accurate deposit of the dispensed liquid at the desired location, that permits accurate control of the bursting force of the package seal, that accurately controls the quantity of the package contents and therefore the amount of the contents dispensed to the desired location, and does not employ glue or other adhesive to seal food or drugs. Adhesive seals make sterility control difficult or impossible.

SUMMARY OF THE INVENTION

The package made in accordance with the invention provides a solution to the prior art problems by incorporating a hollow stem that extends through and is supported by an ultrasonic weld that also provides an end seal of the package. The inner end of the hollow stem extends into the package chamber and is in contact with its liquid contents, and the outer end of the hollow stem extends outside the chamber and is itself provided with a closing seal that is removed when it is desired to dispense the contents of the package.

DETAILED DESCRIPTION OF THE PREFERRED EMBODIMENTS

Figure 1:
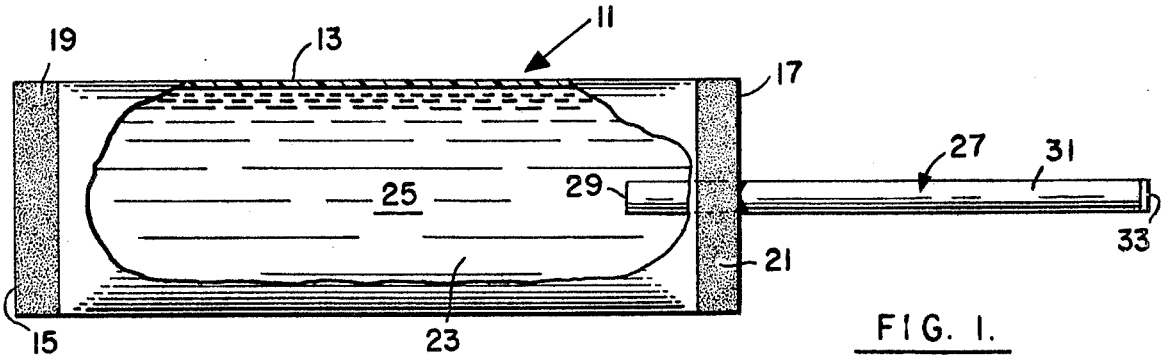
FIG. 1 is a view in elevation of a package constructed in accordance with the invention.
Figure 2:
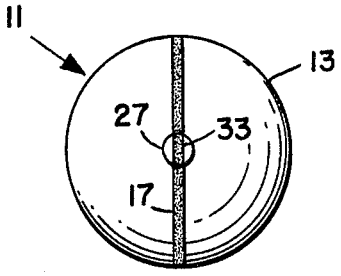
FIG. 2 is an end view of the package of FIG. 1, looking at FIG. 1 from the right.

Turning now to the drawings, there is shown in FIGS. 1 and 2 a package 11 comprising a tube 13 of flexible material which may be made from an extruded synthetic plastic material such as polyethylene. Tube 13 has a first end 15 and a second end 17. A first ultrasonic seal 19 extends transversely across the tube 13 and closes first end 15, and a second ultrasonic seal 21 extends transversely across the tube 13 and closes second end 17. A chamber 23 is formed by tube 13 and its end seals 19, 21 for containing contents 25 which may be a liquid.

A hollow stem 27 extends through and is supported by second ultrasonic seal 21 and has an inner end 29 inside the chamber 23 and in contact with liquid contents 25, and is also provided with an outer end 31 that extends outside the chamber 23. An ultrasonic seal 33 closes the outer end of stem 27 until it is desired to dispense the contents 25. Stem seal 33 is a weaker seal than chamber seals 19 and 21 so that when it is desired to dispense the contents 25, the package 11 is squeezed with one hand to rupture the stem seal 22, and the pressure of the squeezing fingers on the package 11 forces the contents 25 through the inner end 29 of stem 27, through the middle portion of the stem, and through the outer end 31 of the stem to dispense contents 25 at a desired location that is remote from end 17 of the package. Stem 27 permits the contents 25 to be dispensed at what otherwise might be inaccessible places.

Figure 3:
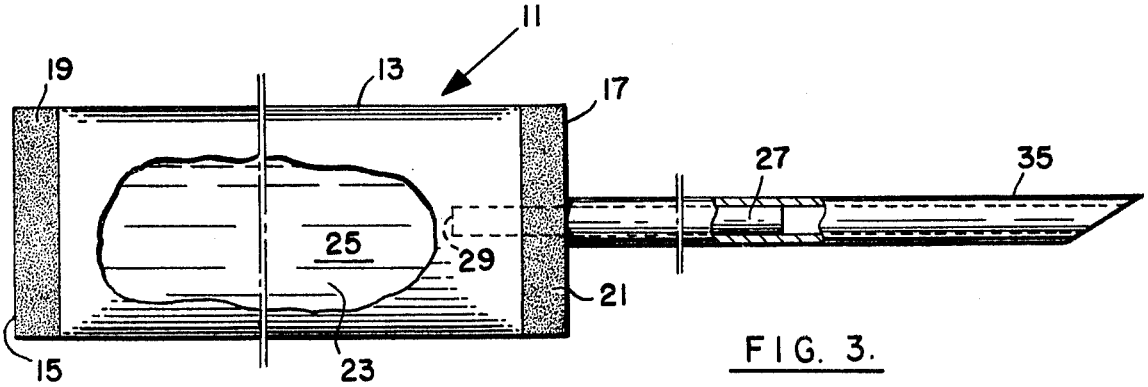
FIG. 3 is a view in elevation showing the package of FIG. 1 with a hypodermic needle mounted thereon.

FIG. 3 discloses and illustrates the package 11 with a hypodermic needle 35 mounted over the stem 27. The contents 25 in the package 11 of FIG. 3 is an injectable solution adapted for injection into a patient by a doctor or nurse. Package 11 of FIG. 3 is a one-shot injection package of a precisely controlled amount of the injectable solution.

One procedure for injecting the solution 25 of package 11 of FIG. 3 is to remove package 11 from a master box containing a plurality of packages with various injectable solutions, wiping of the package 11 clean, or otherwise cleaning the package by soaking it in alcohol, steam, or hot water, removing hypodermic needle 35 from its protective package and placing it over stem 27, squeezing package 11 with thumb and forefinger to break the stem seal 33, squeezing the package 11 gently with hypodermic needle 35 pointing upwardly to make sure any resident air is expelled, inserting the needle into a patient, and squeezing package 11 until its contents are emptied and dispensed into the patient. Then the hypodermic needle 35 is withdrawn from the patient, and the entire package may be discarded. Package 11 of FIG. 3 may be used to dispense morphine and the like in emergency situations such as by the police at automobile accidents, or by soldiers on the battle field, and so on.

Stem 27 may be made of polyethylene or a similar material so as to be compatible with the polyethylene material of tube 13, and may be about 0.5 inches long, 0.16 inches in outside diameter, and 0.08 inches in inside diameter.

Figure 4:
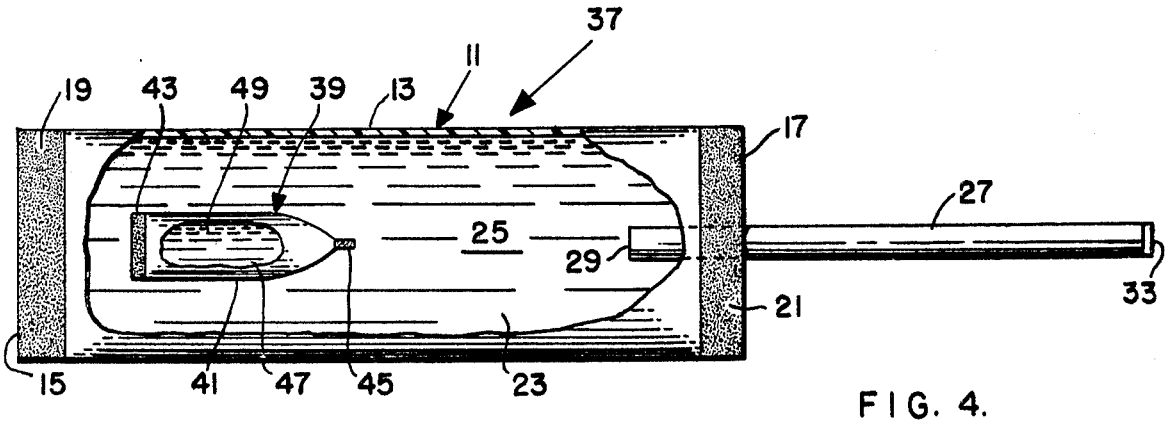
FIG. 4 is a view in elevation of a second embodiment of the invention that includes an inner package and an outer package.

FIG. 4 illustrates a combined package 37 that includes a second or inner package 39 contained within chamber 23 of package 11. Inner package 39 comprises a tube 41 of flexible material closed at its ends by ultrasonic seals 43, 45 that form a second chamber 47 containing second contents 49 which may be a liquid. The ultrasonic seals 43, 45 of inner package 39 are weaker than the ultrasonic seals 19, 21 of the outer package 11, whereby the outer package 11 of FIG. 4 may be squeezed with the fingers to rupture the seals 43, 45 of the inner package 39 and mix its contents 49 with the contents 25 of the outer package 11. After thorough mixing, outer package 11 may again be squeezed harder to rupture stem seal 33 of outer package 11 to dispense the mixed contents 49, 25 of the combined package 37.

Figure 5:
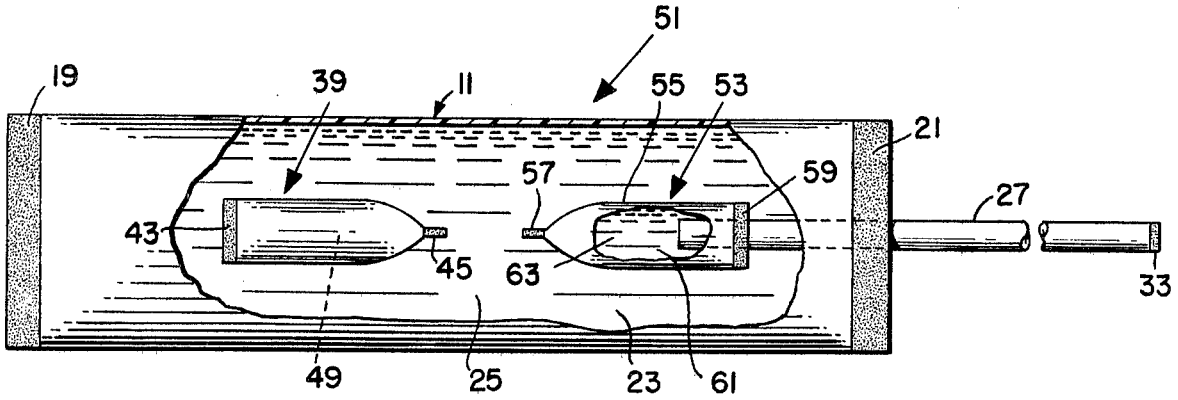
FIG. 5 is a view in elevation of a third embodiment of the invention that includes an outer package and two inner packages.

FIG. 5 shows a third embodiment of the invention, a combined package 51 that includes outer package 11, inner package 39, and a third package 53 that is also contained within chamber 23.

The third package 53 comprises a tube 55 of flexible material closed at its ends by ultrasonic seals 57, 59 that form a third chamber 61 containing third contents 63 which may be a liquid. The seals 57, 59 of third package 53 are stronger than the ultrasonic seals 43, 45 of second package 39 so that the initial squeezing of combined package 51 causes the contents 49 of second package 39 to be dispensed into and mixed with the contents 25 of outer package 11. The contents 25 of outer package 11 and the contents 49 of second package 39 mix together and form a temperature-changing reaction that changes the temperature of the contents 63 in third package 53.

The inner end of stem 27 extends into chamber 61 of the third package. After the temperature of the contents 63 of the third package 53 has been changed to the desired temperature by the mixed contents 25 and 49, the package 51 is again squeezed to rupture the stem seal 33 to dispense the temperature-changed contents 63 of third package 53.

The contents 25 of package 11 and the contents 49 of second package 39 may be such that the temperature-changing reaction is a chilling reaction to lower the temperature of the contents 63 of third package 53. For example, contents 63 of third package 53 may be beer or other beverage that is chilled by the reaction when contents 25 of outer package 11 are mixed with contents 49 of second package 39 before the chilled beer is dispensed from third package 53.

On the other hand, the contents 25, 49 may form an exothermic reaction when mixed together, and the contents of third package 53 may be milk, whereby the outer package 11 is squeezed to rupture the seals 43, 45 of second package 39 and mix its contents 49 with the contents 25 to form a reaction that heats the milk contained by third package 53. When the milk is warm enough, the outer package 11 may again be squeezed, and squeezed harder to rupture the stem seal 33 to dispense the heated milk to a baby, for example.

Figure 6:
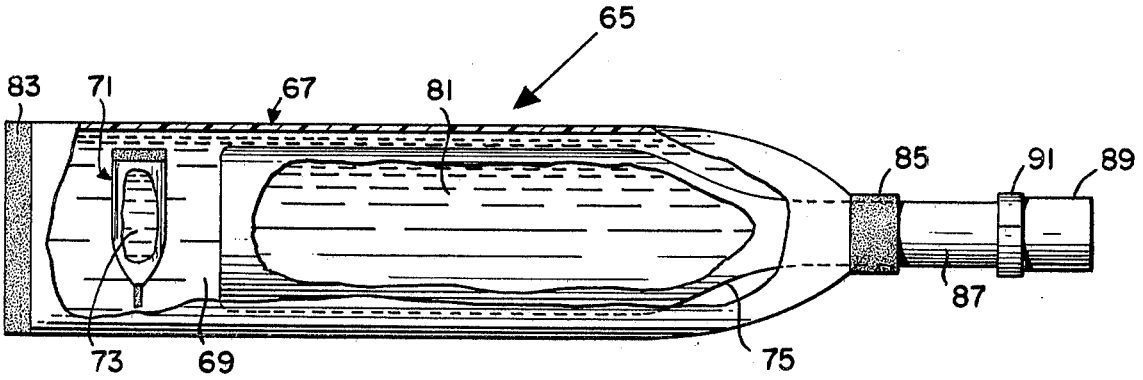
FIG. 6 shows a view in elevation of a fourth embodiment of the invention that includes an outer package and two inner packages.
Figure 7:
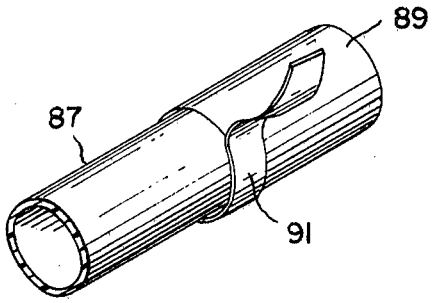
FIG. 7 shows a partial view of a tear-off top of the package of FIG. 6.

FIG. 6 discloses a fourth embodiment of the invention and shows a combined package 65 that includes an outer package 67 having contents 69, a second or inner package 71 contained within outer package 67 and having contents 73, and a bottle or can 75 containing a beverage 81, which may be beer.

Outer package 65 is provided with an ultrasonic seal 83 at one end, and a seal 85 at the other end that seals to the neck portion 87 of bottle 75. Bottle 75 is sealed by a cap 89 that may be attached to neck portion 87 by a tape 91.

In operation, when it is desired to drink the beverage 81, outer package 67 is squeezed to break the seals of second package 71 and mix its contents 73 with the contents 69 of outer package 67 to create an endothermic reaction and chill the beverage 81. When properly chilled, cap 89 is removed by unwinding tape 91 and the beverage 81 is poured from the bottle 75.

In order to heat the contents 63 of package 53 in FIG. 5, contents 25 of outer package 11 may be water and contents 49 of inner package 39 may be a liquid which forms an exothermic reaction with water, such as $AlBr_3$ (aluminum bromide). Aluminum bromide in water at 80° C the solubility is 12.6 g. per 10 g. water. The rate of solution for $AlBr_3$ is 85.3 Kg-Cal per mole of $AlBr_3$. The weight of 1 gram mole of $AlBr_3$ is $(27 + 79.9 \times 3) = 266.7$ g. Therefore, the heat evolved when dissolving 12.6 g. $AlBr_3$ in water is:

$$\frac{12.6\ g.\ AlBr_3}{266.7\ \frac{g.}{g.\ \text{mole}}} \times \frac{85.3\ Kg\text{-}Cal}{g.\ \text{mole}\ AlBr_3} = 4.03\ KCal$$

In order to chill the contents 81 of bottle 75 in FIG. 6, contents 69 of outer package 67 may be water, and contents 73 of second package 71 may be a liquid which forms an endothermic reaction with water, such as $Ba(No_3)_2$ (barium nitrate). The heat of solution of barium nitrate is $-10.2$ Kg-Cal per g. mole, and at 80° C the solubility is 27 g. per g. of water. The weight of 1 g. mole of barium nitrate is $[137.32 \times 2\ (14 + 3 \times 16)] = 261$ g. Therefore, the heat which must be added to maintain the solution temperature is (when dissolving 27 g. of barium nitrate in water)

$$\frac{27\ g.\ \text{of}\ Ba(No_3)_2}{261.4\ \frac{g.}{g.\ \text{mole}}} \times \frac{-10.2\ Kg\text{-}Cal}{g.\ \text{mole}\ Ba(NO_3)_2} = -1.05\ KCal$$

I claim:

1. A package comprising a tube of flexible material having a first and second end, a first seal extending transversely across the tube and closing said first end, a second seal extending transversely across the tube and closing said second end, a chamber formed by said tube and said end seals for containing contents, hollow stem dispensing means extending through and supported by said second seal with an inner end inside the tube and an outer end outside the tube, means closing the outer end of the stem, a second package contained within said chamber to form an inner package while the first-said package forms an outer package, said inner package comprising a tube of flexible material closed at its ends by seals that form a second chamber containing second contents, with the seals of the inner package being weaker than the seals of the outer package, a third package contained within the first-said chamber, said third package comprising a tube of flexible material closed at its ends with seals that form a third chamber containing third contents, with the seals of the third package being stronger than the seals of the second package, with the inner end of said stem extending into the chamber of the third package, the contents of the first and second packages forming a temperature-changing reaction when mixed together, whereby the outer package may be squeezed to rupture a seal of the second package and mix its contents with the contents of the outer package to form a reaction which changes the temperature of the contents of the third package, and whereby the stem closing means may be opened and the outer package may be squeezed to dispense the temperature-changed contents of the third package.

2. The package of claim 1, wherein said temperature-changing reaction is a chilling reaction to lower the temperature of the contents of the third package.

3. The package of claim 2, wherein said third package contains beer or the like.

4. The package of claim 1, the contents of the first and second packages forming an exothermic reaction when mixed together to raise the temperature of the contents of the third package.

5. The package of claim 4, wherein said third package contains milk to be fed to a baby.

6. The package of claim 1, wherein said stem closing means comprises a molded cap, and a tape mounting the cap onto the outer end of the stem.

* * * * *